US006474416B2

(12) United States Patent
Beall et al.

(10) Patent No.: US 6,474,416 B2
(45) Date of Patent: Nov. 5, 2002

(54) REMOTELY INSTALLED PRESSURE CONTAINING CLOSURE

(75) Inventors: Scott Kennedy Beall; Roy Ortiz, both of Houston, TX (US)

(73) Assignee: Kvaerner Oilfield Products, Houston, TX (US)

( * ) Notice: Subject to any disclaimer, the term of this patent is extended or adjusted under 35 U.S.C. 154(b) by 3 days.

(21) Appl. No.: 09/757,870

(22) Filed: Jan. 10, 2001

(65) Prior Publication Data

US 2002/0088622 A1 Jul. 11, 2002

(51) Int. Cl.[7] ..... E21B 43/01
(52) U.S. Cl. ..... 166/343; 166/368
(58) Field of Search ..... 166/339, 340, 166/341, 343, 360, 366, 368

(56) References Cited

U.S. PATENT DOCUMENTS 4,405,016 A * 9/1983 Best ..... 166/337
5,107,931 A * 4/1992 Valka et al. ..... 166/342
5,992,526 A 11/1999 Cunningham ..... 166/343

* cited by examiner

*Primary Examiner*—William Neuder
(74) *Attorney, Agent, or Firm*—Buskop Law Group, P.C.; Wendy Buskop

(57) ABSTRACT

A remotely installed pressure containing closure having a slight negative buoyancy, and a method for assembly of a slight negative buoyancy remotely installed pressure containing closure, such as a tree cap, on a subsea assembly, having at least one fluid bore, and more preferably a production bore and an annulus bore, wherein the remotely installed pressure containing closure comprises: a guidance ring having a plurality of chambers; optionally, a plurality of orientation pins affixed to the guidance ring for aligning the guidance ring to a funnel; buoyant material disposed in the chambers of the guidance ring to assist in creating a slight negative buoyancy for the remotely installed pressure containing closure; a cylinder connected to the remotely installed pressure containing closure for engaging sealing means on a subsea assembly for sealing at least one seal of at least one fluid bore of said subsea assembly; a debris cover connected to said cylinder to house equipment and cover the fluid bore; a mandrel having at least one fluid bore disposed under said debris cover; an actuator secured to said cylinder; a plurality of locking dogs attached to said actuator by a plurality of rotatable rods for locking down said remotely installed pressure containing closure onto said mandrel; a rotatable handle secured to said actuator; a handle extension rod connected to said handle; a handle locking sleeve connected to said handle extension rod; and a locking ring in slidable engagement with said handle locking sleeve for engaging said ring against said subsea mandrel; and at least one dual function stab port for receiving a stab to activate the hydraulic cylinder.

21 Claims, 5 Drawing Sheets

REMOTELY INSTALLED PRESSURE CONTAINING CLOSURE

FIELD OF THE INVENTION

This invention relates to subsea assemblies, particularly tree caps for subsea Christmas trees, and a method for placing a tree cap on a subsea assembly with an ROV which is faster and safer than traditional methods.

This invention relates generally to the field of equipment and methods of installation thereof of subsea wellhead equipment. In particular, the invention concerns a ROV deployed cap for a Xmas tree for a subsea well and the method of installing and retrieving the tree cap.

BACKGROUND AND OBJECTS OF THE INVENTION

Prior tree caps have been installed by using a drill pipe connector arrangement. Prior tree cap design has been elaborate almost a piece of art. Extensive machining and weight issues became the norm. An extra trip of the drill pipe was required simply to retrieve or lower the tree cap. As the offshore oil industry moves to deeper and deeper depths, the time that it takes to lower or retrieve the tree cap with drill pipe will cost a well operator thousands of dollars in rig time alone.

Accordingly, a primary object of the invention is to provide a lightweight ROV installable tree cap for a subsea Xmas tree.

Another object is to provide a method of installing and retrieving the tree cap by using pressure fluid apparatus for stabbing the cap in place on the production hub and for retrieving the cap.

SUMMARY OF THE INVENTION

The present invention is a remotely installed pressure containing closure, such as a tree cap that be easily installed by a ROV (Remotely Operated Vehicle) onto a subsea Xmas tree, and have the capability to test the production seals and annulus seals prior to producing oil via the well.

A remotely installed pressure containing closure, such as a tree cap, for a subsea assembly having at least one fluid bore comprising: a guidance ring having a plurality of chambers; a plurality of pins affixed to said guidance ring for aligning the guidance ring to a finnel; buoyant material disposed in the chambers of said guidance ring; a cylinder connected to a tree cap body for engaging sealing means on a subsea assembly for sealing at least one seal of at least one fluid bore of said subsea assembly; a debris cover connected to said cylinder to house equipment and cover the fluid bore; a mandrel having at least one fluid bore disposed under said debris cover; an actuator secured to said cylinder; a plurality of locking dogs attached to said actuator by a plurality of rotatable rods for locking down said tree cap onto said mandrel; a rotatable handle secured to said actuator; a handle extension rod connected to said handle; a handle locking sleeve connected to said handle extension rod; a locking ring in slidable engagement with said handle locking sleeve for engaging said ring against said subsea mandrel; and at least one dual function stab port for receiving a stab to activate the hydraulic cylinder.

According to a preferred embodiment of the invention, a tree cap can be constructed with a rotatable handle in an actuator, which has slight negative buoyancy, thereby providing a tree cap that can be easily locked into place on a subsea Xmas tree.

The ROV engages a handle secured to an actuator, pressure is applied with a hydraulic means enabling the fluid seals to be secured in place.

The handle is preferably latchable, and the tree cap is self-aligning.

The tree cap is designed to have slight negative buoyancy when submerged so that it may be easily handled by a ROV utilizing buoyant material. Additionally, the tree cap may utilize various components, which have light densities.

The invention also includes the method for installing the novel tree cap.

Other objects, features, and advantages of the invention will be apparent from the following specification and drawings.

BRIEF DESCRIPTION OF THE DRAWINGS

The objects, advantages, and features of the invention will become more apparent by reference to the drawings which are appended hereto and wherein like numerals indicate like parts and wherein an illustrative embodiment of the invention is shown, of which.

BRIEF DESCRIPTION OF THE INVENTION

The present invention relates to a remotely installed pressure containing closure with slight negative buoyancy, such as a tree cap for use on subsea well heads and a novel method for using the remotely installed pressure containing closure on a subsea Christmas (Xmas) tree.

Figure 1:
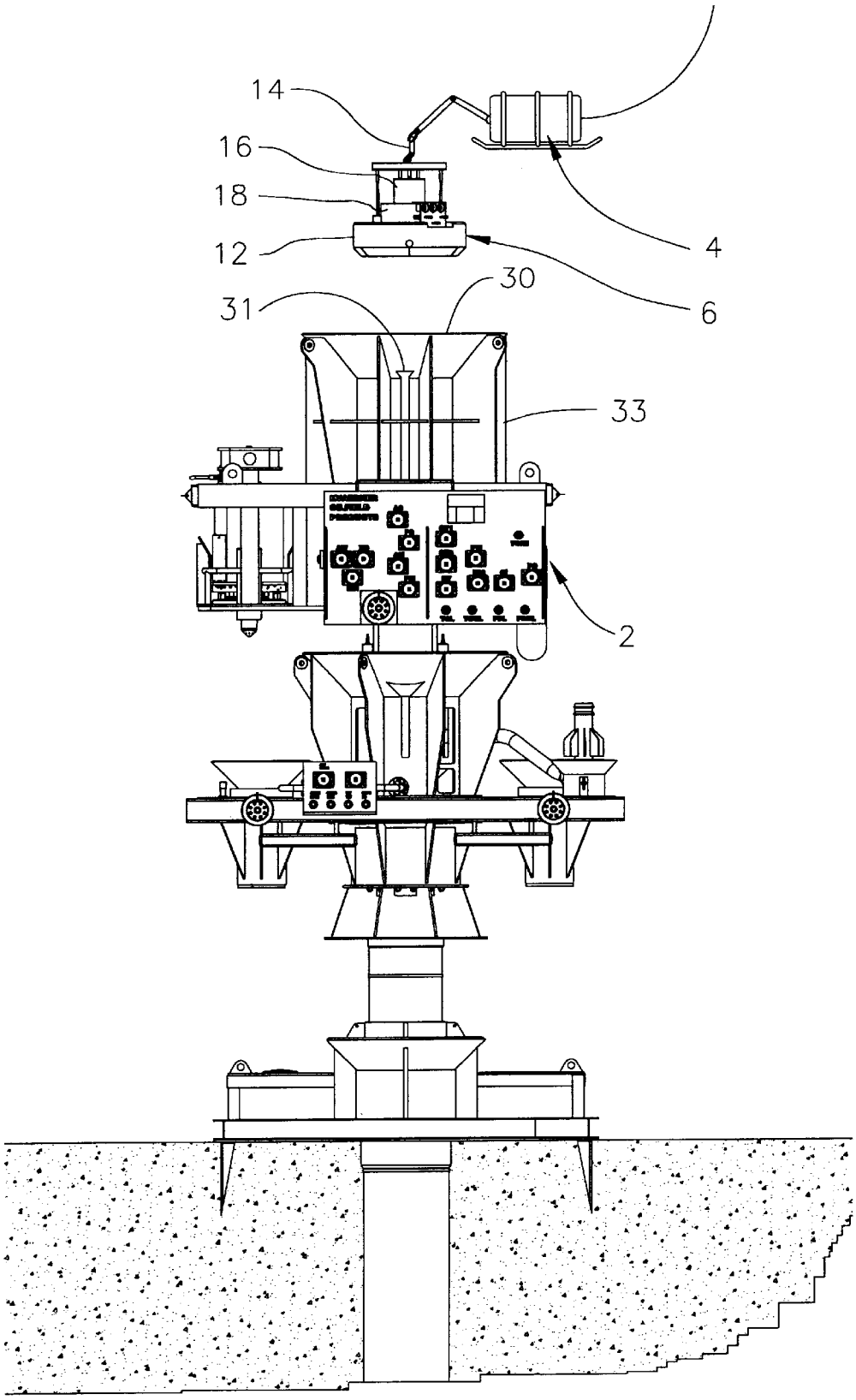
FIG. 1 is a side view of an ROV deploying the tree cap comprising the present invention on the production hub of a subsea Xmas tree.

Referring now particularly to FIG. 1, a Xmas tree production hub 2 is shown with an ROV 4 holding a remotely installed pressure containing closure, which in this FIG is shown as tree cap 6 by a rotatable handle 14. Rotatable handle 14 is connected to an actuator 16. Actuator 16 connects to a debris cover 18 that houses all the equipment and protects the mandrel (shown in FIG. 2) of the subsea Christmas tree 2. The Christmas tree has a production bore 66 and an annulus bore 64 therein (shown in FIG. 3). Returning to FIG. 1, the tree cap 6, has a guidance ring 12 connected to the debris cover 18.

The subsea Xmas tree production hub 2, preferably has a finnel guide 30 supported on a ribs 33.

Y-shaped slots 31 extend in a generally vertical direction and a pair of opposed upper slots not shown are provided along the upper surface of funnel guide 30. The funnel guide is also referred to as a capture funnel in the art.

Figure 2:
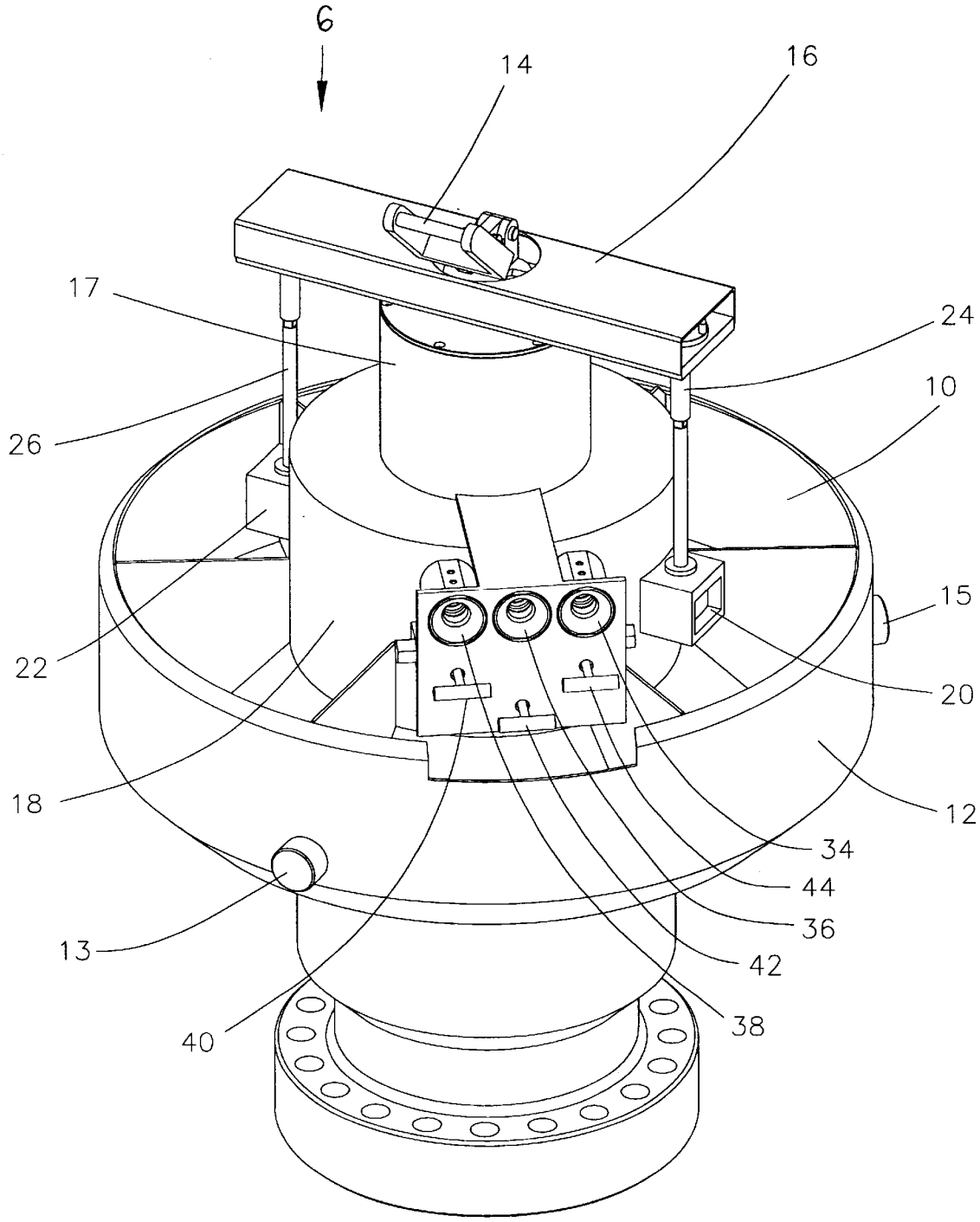
FIG. 2 is a perspective view of the tree cap shown in FIG. 1 removed from the subsea production hub.

In FIG. 2, the tree cap 6 is shown. A handle 14 is connected to an actuator 16. Orientation pins 13 and 15 extend from the body of tree cap 6 to be received within the Y-slots 31 of the funnel guide 30 for initial alignment of the tree cap 6 on the Xmas tree. Foam 10 is located in the slots of the guidance ring 12. Adequate foam 10 is inserted to provide a slight negative buoyancy so that the ROV can easily maneuver the tree cap 6 using a manipulator arm while submerged in water. Foam 10 in the most preferred embodiment is syntactic foam.

Upon rotation of handle 14, which is connected to an actuator 16, first and second rods, 24 and 26, respectively, causing first and second locking dogs 20 and 22 respectively, to extend inwardly to form a latching relationship with the production Xmas tree. In a preferred embodiment, the locking dogs are cam actuated. It is also preferred that the handle be rotatable between 10 and 180 degrees, preferably 45 degrees. The handle is preferably engagable with an ROV manipulator arm, but it is within the scope of the invention that a diver could possibly operate this or that the handle could be actuated from a surface device or a sub.

Figure 5:
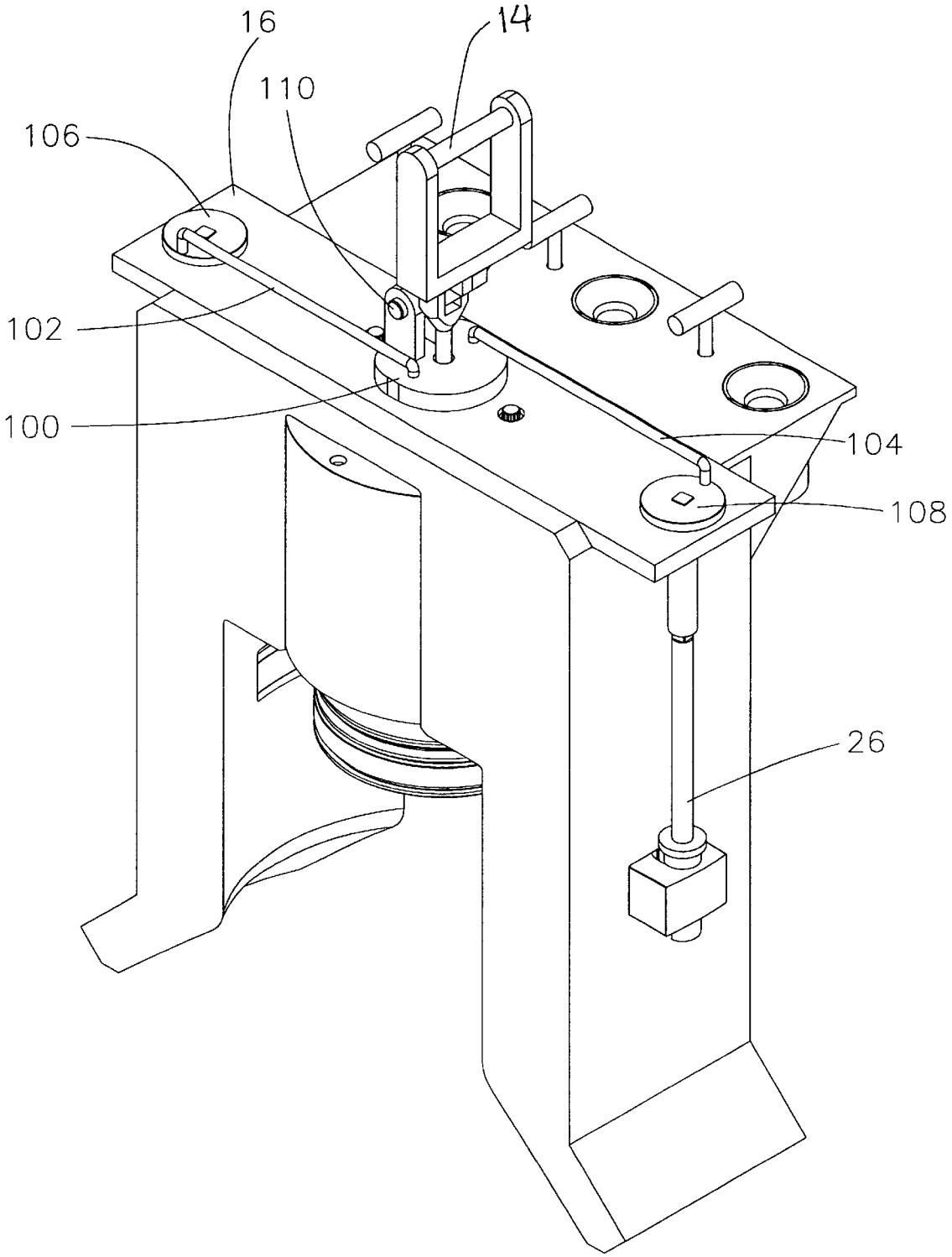
FIG. 5 is a detailed view of a part of the tree cap of FIG. 2.

The actuator 16 is preferably a bell crank. The bell crank is shown in detail in FIG. 5. The actuator 16 is connected to the handle 14 via a first rotatable disc 100 which in turn is connected to a first actuator rod 102 and a second actuator rod 104. The first actuator rod is connected to a second rotatable disc 106 and the second rotatable rod is connected to a third rotatable disc 108. The second rotatable disc 106 is connected to first rod 24 not shown in FIG. 5, but shown in FIG. 2, and the third rotatable disc 108 is connected to second rod 26 shown in FIG. 5 A pivot pin 110 connects handle 14 to the first rotatable disc 100.

Figure 3:
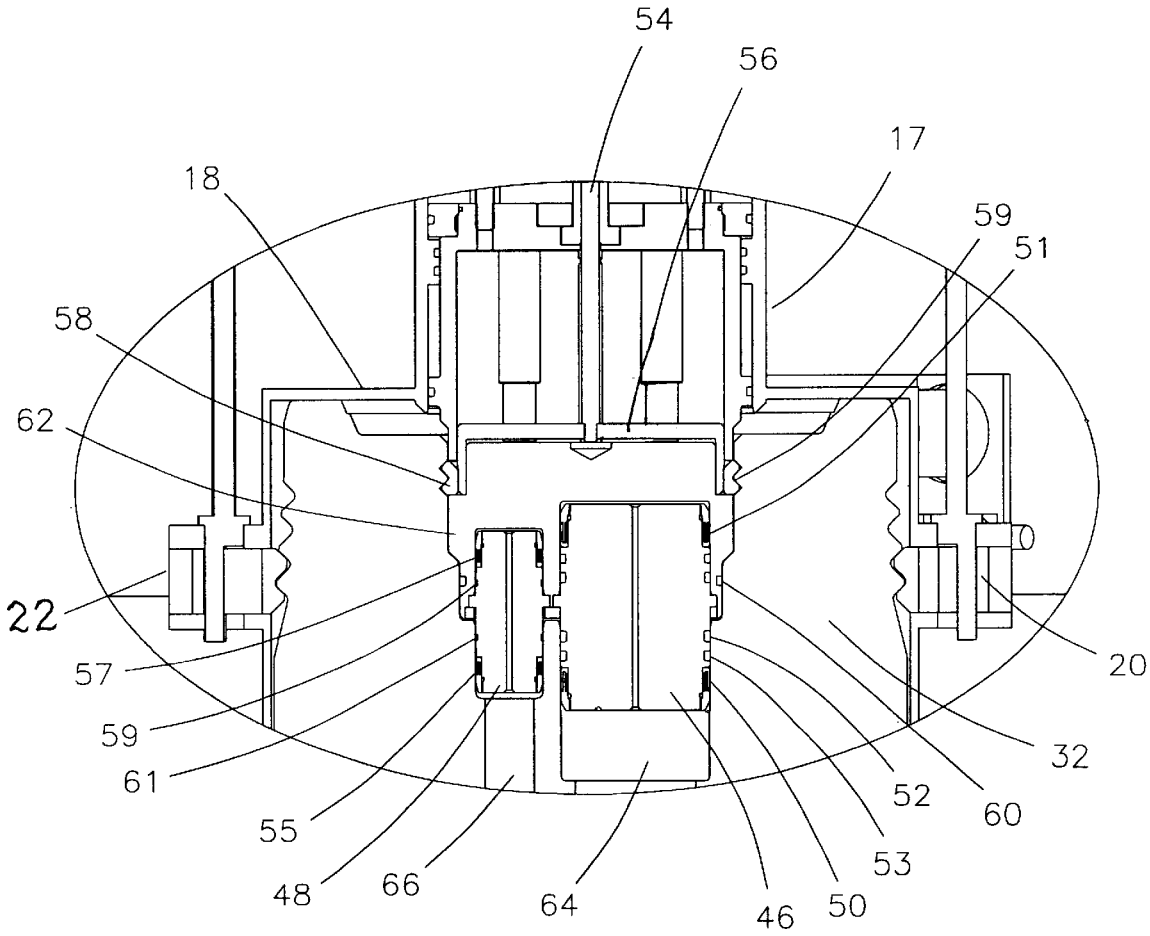
FIG. 3 is a cross-sectional view of the tree cap shown in FIG. 2.

Returning to FIG. 2, the rotatable handle 14 is connected to a cylinder 17, which is preferably a fluid actuatable cylinder, such as a hydraulic cylinder. The cylinder 17 is connected to a debris cover 18 that houses all sealing equipment and protects the mandrel 32 which is shown in FIG. 3. Preferably the handle 14 is center mounted on the tree cap. It is within the scope of the invention that the cylinder 17 and debris cover 18 also be center mounted on the tree cap. It is preferred that the mandrel also has a plurality of global seals on the sides of the mandrel.

In FIG. 2, three stab receptacles are present, receptacles 34, 36 and 38 for stabbing and fitting in sealing relation with production bore 66 and annulus bore 64 of the subsea Xmas tree. These first, second and third receptacles can be dual fiction stab receptacles or stab ports. At least two hot stabs can be inserted in the receptacles for pressure testing of the bore seals. Suitable annular elastomeric seals can extend about the hot stab, which can be tubular, for effective sealing during pressure testing against bores 66 and 64. Three corresponding isolation valves, first isolation valve 40, second isolation valve 42, and third isolation valve 44 can be used to isolate the production bore 66 and an annulus bore 64 after pressure testing. The production bore can be sealed with a first barrier seal 46 and the annular bore can be sealed with a second barrier seal 48. The barrier seals can be either the production bore seal, the annulus bore seal combinations of those seals, and may include a plurality of annulus seals. Metal seals, 50, 51, 55 and 57 and O-rings 52, 53, 59 and 61 can be used to assist in sealing the bores 64 and 66 as shown in FIG. 3.

The actuator 16 connects between handle 14 and handle extension rod 54 shown in FIG. 3. The handle extension rod 54 connects to a locking sleeve 56, which in turn slides against a locking ring 58. The internal locking profile 59 exists on the inner diameter of the mandrel for securing the locking ring 58 to the mandrel 32. Mandrel global seal 60 can be used, which can be an O-ring, or a metal-to-metal seal, or a thermoplastic seal. Sealing means 62 can be used which can be either a seal carrier. It is within the scope of the invention that the handle extension rod 54 be center mounted on the tree cap.

Figure 4:
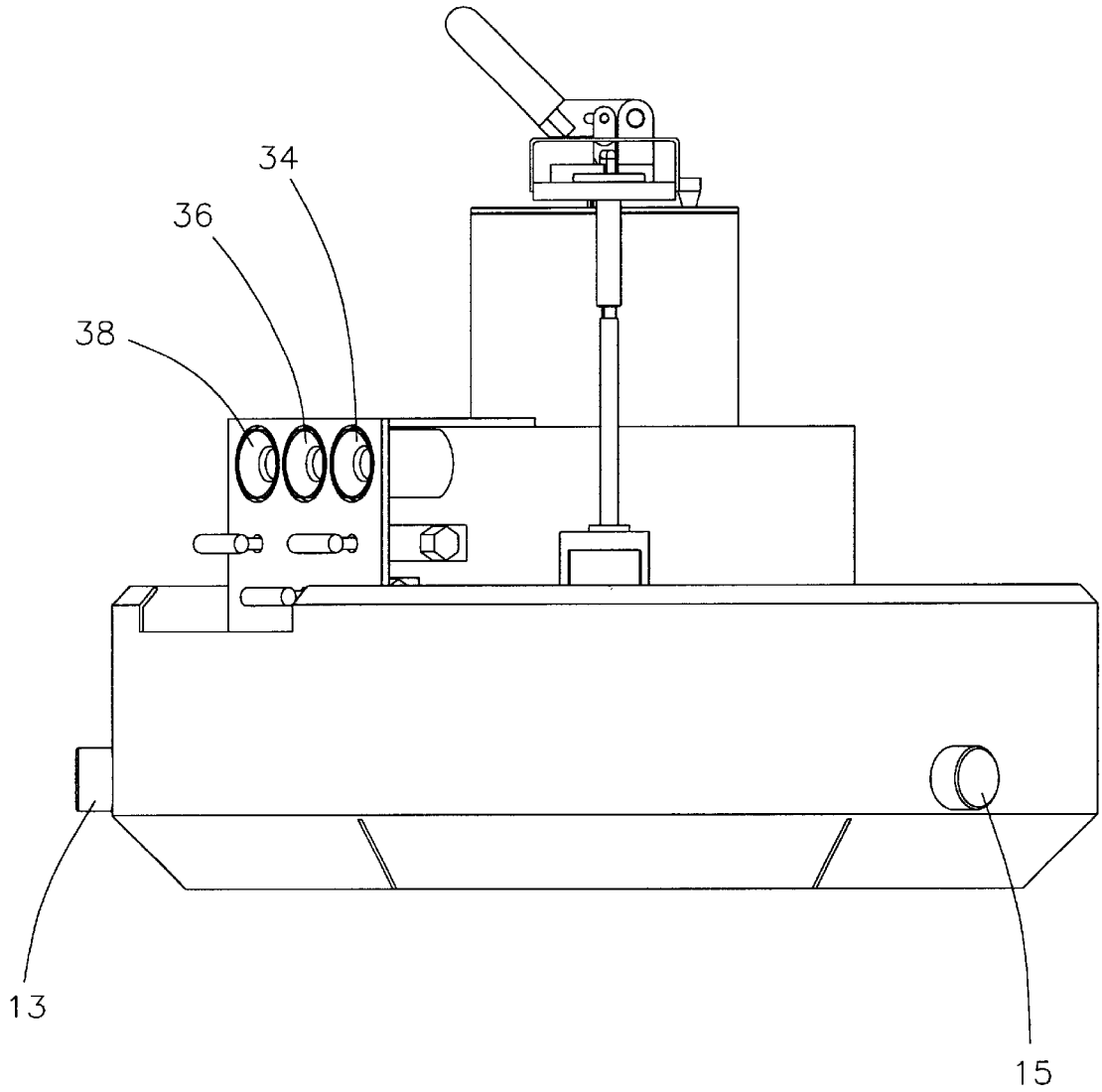
FIG. 4 is another side view of the tree cap shown in FIGS. 2 and 3.

FIG. 4 is a side view of the tree cop in the locked position with receptacles 34, 36 and 38.

The invention also relates to a method for installing a remotely installed pressure containing closure, such as a tree cap, on a subsea assembly which involves the steps of gripping a handle having a handle extension rod connected to a handle locking sleeve on a remotely installed pressure containing closure having a slight negative buoyancy, with an ROV; positioning the remotely installed pressure containing closure, shown in the Figs, as a tree cap, over a subsea assembly having an optional a capture funnel, using an ROV; landing the remotely installed pressure containing closure on the subsea assembly with the ROV; aligning the remotely installed pressure containing closure onto a mandrel on the subsea assembly using orientation pins on the remotely installed pressure containing closure and engaging the orientation pins in slots on the capture funnel; rotating the handle between 10 and 180 degrees to secure the remotely installed pressure containing closure on the mandrel with at least one pair of locking dogs; actuating a hydraulic cylinder downwardly to seal at least one fluid bore using at least one hot stab; such as with a seal carrier, or similar sealing means, then downwardly moving the handle and handle extension rod and sleeve; latching the handle into place, sliding the sleeve against the locking ring, thereby locking the remotely installed pressure containing closure to the mandrel. It has been discovered that in the preferred embodiment, the sealing means comprises at least one global seal.

The invention also involves the additional step of engaging a second hot stab in a second receptacle or port, performing a seal test using the hot stab and then closing the port. In still another embodiment, the invention can include the step of: providing releasable locking members for the guidance ring, for releasing the remotely installed pressure containing closure, such as a tree cap from the subsea assembly.

Additionally, an embodiment of the invention can include the step of: operating the rotatable handle for unlatching of the orientation pins from the subsea assembly.

As a further option, the invention can involve a plurality of ROV accessible control elements on the remotely installed pressure containing closure, such as the tree cap, for controlling a releasable connection of the remotely installed pressure containing closure on the subsea assembly, with the control elements having handles positioned for engagement by manipulator arms of the ROV for permitting installation of the remotely installed pressure containing closure on the subsea Xmas tree and retrieval of the remotely installed pressure containing closure, such as a tree cap, from the subsea assembly.

The present invention and the best modes of practicing it have been described. It is to be understood that the foregoing descriptions are illustrative only and that other means and techniques can be employed without departing from the full scope of the invention as described in the appended claims.

What is claimed is:

1. A remotely installed pressure containing closure for a subsea assembly having at least one fluid bore comprising:

a guidance ring having a plurality of chambers;

a plurality of pins affixed to said guidance ring for aligning the guidance ring to a funnel;

buoyant material disposed in the chambers of said guidance ring;

a cylinder connected to the guidance ring for engaging sealing means on a subsea assembly for sealing at least one seal of at least one fluid bore of said subsea assembly;

a debris cover connected to said cylinder to house equipment and cover the fluid bore;

a mandrel having at least one fluid bore disposed under said debris cover;

an actuator secured to said cylinder;

a plurality of locking dogs attached to said actuator by a plurality of rotatable rods for locking down said remotely installed pressure containing closure onto said mandrel;

a rotatable handle secured to said actuator;

a handle extension rod connected to said handle;

a handle locking sleeve connected to said handle extension rod; and a locking ring in slidable engagement with said handle locking sleeve for engaging said ring against said subsea mandrel; and sealing means for sealing a production bore by engaging said locking ring;

at least one dual function stab port for receiving a stab to activate a hydraulic cylinder.

2. The remotely installed pressure containing closure of claim 1, wherein said closure is a tree cap for a subsea Xmas tree.

3. The remotely installed pressure containing closure of claim 1, wherein said locking dogs are cam actuated.

4. The remotely installed pressure containing closure of claim 1, wherein said handle is rotatable between 10 and 180 degrees.

5. The remotely installed pressure containing closure of claim 1, wherein said handle can be engaged with an ROV arm.

6. The remotely installed pressure containing closure of claim 1, wherein said handle and handle extension rod are center mounted on the remotely installed pressure containing closure.

7. The remotely installed pressure containing closure of claim 1, wherein said mandrel has global seals disposed on the sides to seal the mandrel.

8. The remotely installed pressure containing closure of claim 1, wherein a barrier seal is a member of the group consisting of: a production bore seal, an annulus bore seal and combinations thereof.

9. The remotely installed pressure containing closure of claim 1, further comprising at least one isolation valve.

10. The remotely installed pressure containing closure of claim 1, wherein said remotely installed pressure containing closure contains enough buoyant material to achieve a neutral buoyancy while submerged in water.

11. The remotely installed pressure-containing closure of claim 1, wherein said buoyant material is syntactic foam.

12. The remotely installed pressure containing closure of claim 1, wherein said sealing means is a seal carrier.

13. The remotely installed pressure containing closure of claim 11, wherein said sealing means further comprises at least one global seal.

14. The remotely installed pressure containing closure of claim 1, wherein said cylinder is hydraulic.

15. A subsea assembly having at least one fluid bore comprising:

a tree cap consisting of:

a guidance ring having a plurality of chambers;

buoyant material disposed in the chambers of said guidance ring;

a cylinder connected to a tree cap body for engaging sealing means on a subsea assembly for sealing at least one seal of at least one fluid bore of said subsea assembly;

a debris cover connected to said cylinder to house equipment and cover the fluid bore;

an actuator secured to said cylinder;

a plurality of locking dogs attached to said actuator by a plurality of rotatable rods for locking down said tree cap onto said mandrel;

a rotatable handle secured to said actuator;

a handle extension rod connected to said handle;

a handle locking sleeve connected to said handle extension rod; and a locking ring in slidable engagement with said handle locking sleeve for engaging said ring against said subsea mandrel; and at least one dual function stab port for receiving a stab to activate the hydraulic cylinder.

16. A method for installing a remotely installed pressure containing closure on a subsea assembly comprising:

gripping a handle having a handle extension rod connected to a handle locking sleeve on a remotely installed pressure containing closure having a slight negative buoyancy with an ROV;

positioning the remotely installed pressure containing closure over a subsea assembly with a capture funnel with said ROV;

landing the remotely installed pressure containing closure on the subsea assembly with said ROV;

aligning said remotely installed pressure containing closure onto a mandrel on said subsea assembly using orientation pins on said remotely installed pressure containing closure and engaging said orientation pins in slots on said capture funnel;

rotating said handle between 10 and 180 degrees to secure said remotely installed pressure containing closure on said mandrel with at least one pair of locking dogs; actuating a hydraulic cylinder downwardly to seal at least one fluid bore using at least one hot stab;

downwardly moving said handle, handle extension rod and sleeve, and latching said handle into place, sliding said sleeve against a locking ring, thereby locking the remotely installed pressure containing closure to the mandrel.

17. The method of claim 16, further comprising the step of engaging a second hot stab in a second port, performing a seal test using the hot stab and then closing said port.

18. The method of claim 16, further including the step of providing releasable locking members for a guidance ring, for releasing said remotely installed pressure containing closure.

19. The method of claim 16 further including the step of: operating said rotatable handle for unlatching of said orientation pins from said subsea assembly.

20. The method of claim 16, including the step of:

mounting said ROV on said remotely installed pressure containing closure for controlling a releasable connection of the remotely installed pressure containing closure on the subsea assembly, the control elements having handles positioned for engagement by manipulator arms of the ROV for permitting installation of the remotely installed pressure containing closure on the subsea assembly and retrieval of the remotely installed pressure containing closure from the subsea assembly.

21. The method of claim 16, wherein said remotely installed pressure containing closure is a tree cap.

* * * * *